US010113515B1

(12) United States Patent
Yoon et al.

(10) Patent No.: US 10,113,515 B1
(45) Date of Patent: Oct. 30, 2018

(54) WATER COOLED EGR COOLER

(71) Applicants: Hyundai Motor Company, Seoul (KR); Kia Motors Corporation, Seoul (KR)

(72) Inventors: Sung Il Yoon, Seoul (KR); Do Jun Park, Ulsan (KR); Dong Young Lee, Goyang-si (KR); In Sung Yun, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/802,324

(22) Filed: Nov. 2, 2017

(30) Foreign Application Priority Data

Apr. 28, 2017 (KR) ..... 10-2017-0055565

(51) Int. Cl.
*F02M 26/29* (2016.01)
*F02M 26/32* (2016.01)
*F02M 26/28* (2016.01)

(52) U.S. Cl.
CPC ..... *F02M 26/32* (2016.02); *F02M 26/28* (2016.02); *F02M 26/29* (2016.02)

(58) Field of Classification Search
CPC ..... F02M 26/28; F02M 26/29; F02M 26/32
USPC ..... 123/568.12
See application file for complete search history.

(56) References Cited

U.S. PATENT DOCUMENTS

2009/0260786 A1* 10/2009 Palanchon ..... F28D 9/0031 165/176
2010/0108042 A1* 5/2010 Akiyoshi ..... B23K 1/0012 123/568.12
2014/0182821 A1* 7/2014 Perrin ..... B32B 15/016 165/109.1
2016/0334169 A1* 11/2016 Rubitschek ..... F02M 26/29

FOREIGN PATENT DOCUMENTS

JP 4773541 B2 9/2011
JP 5468809 B2 4/2014
KR 10-2014-0000406 A 1/2014
KR 10-1623088 B1 5/2016
WO WO 2008 063855 * 5/2008 ..... F02B 37/00

* cited by examiner

*Primary Examiner* — Erick Solis
(74) *Attorney, Agent, or Firm* — Morgan, Lewis & Bockius LLP

(57) ABSTRACT

A water-cooled exhaust gas recirculation (EGR) cooler may include tubes positioned within a housing at a predetermined interval, which forms an exhaust gas passage that exhaust gas passes therethrough, and a tube bonded portion that seals internally and externally the tube is provided at a first side of the tube; and supporters interpose the tubes to define a predetermined interval between the tubes and positioned within the housing wherein a coolant passage which a coolant flows between the tubes is formed, wherein an external surface of a first side of the supporter is bonded to an external surface of the tubes to form a reinforcing bonded portion wherein the supporter covers and seals the tube bonded portion.

10 Claims, 4 Drawing Sheets

WATER COOLED EGR COOLER

CROSS-REFERENCE(S) TO RELATED APPLICATIONS

The present application claims priority to Korean Patent Application No. 10-2017-0055565, filed on Apr. 28, 2017, the entire contents of which are incorporated herein for all purposes by this reference.

BACKGROUND OF THE INVENTION

Field of the Invention

The present invention relates to a water-cooled EGR cooler configured for cooling exhaust gas re-circulated from an exhaust line to an intake line with a coolant therein. More particularly, the present invention relates to a water-cooled EGR cooler configured for decreasing corrosion of a bonded portion of a plurality of tubes and improving a supporting structure using a supporter located between the tubes.

Description of Related Art

In recent years, as environmental problems including global warming emerge, regulations for exhaust gas have been tightened, in particular, emissions of the exhaust gas of a vehicle have been strictly controlled. Particularly, under the EURO-6 standard, in a case of a diesel engine for a vehicle, a quantity of $NO_x$ generated needs to be decreased to a level of 80 mg/km, and in the present respect, automobile related companies have adopted new technologies, including an exhaust gas recirculation (EGR) device, a Lean $NO_x$ Trap (LNT) device, and a selective catalytic reduction (SCR) device. The exhaust gas recirculation (EGR) device includes a high pressure exhaust gas recirculation (HP-EGR) device which recirculates exhaust gas at a front end portion of a catalyst, and a low pressure exhaust gas recirculation (LP-EGR) device which recirculates exhaust gas at a rear end portion of the catalyst. In the present case, to cool the recirculated exhaust gas, an EGR cooler is disposed in an exhaust gas recirculation line, and the EGR cooler includes a stainless material having a high corrosion resistivity to a high temperature state and condensate water. However, the EGR cooler including the stainless material is heavy, has low heat transfer efficiency, has a poor molding property, and the components are expensive.

Accordingly, research on the EGR cooler which has a high heat transfer efficiency, has an excellent molding property, includes aluminum, and of which components are relatively cheap has been conducted. Typically, the present aluminum material EGR cooler includes a cooling pin and tubes, A1100 which is based on pure aluminum (A1xxx) and A3003 which is based on aluminum-manganese (A3xxx) may be used in the cooling pin and tubes.

Meanwhile, a temperature of recirculated exhaust gas is approximately 550° C. and corrosive ions, including Cl—, $SO_4^{2}$—, and $NO_3$—, exist as an inclusion of condensate water, wherein the aluminum-based cooling pin or tube may be damaged in a high temperature environment and a corrosive environment. In the present respect, research on an aluminum sheet having a high strength and a high corrosion resistivity is conducted. Particularly, a welding portion of the tube corrodes in condensate water and the high temperature condition, and the coolant leaks toward an interior of the tube, therefore, a durability of the EGR cooler may deteriorate.

The information disclosed in this Background of the Invention section is only for enhancement of understanding of the general background of the invention and should not be taken as an acknowledgement or any form of suggestion that this information forms the related art already known to a person skilled in the art.

BRIEF SUMMARY

Various aspects of the present invention are directed to providing a water cooled EGR cooler, in which a combination structure between a bonded portion of a tube and a supporter is improved and corrosion of the bonded portion is decreased to improve durability of the cooler, and an interval between the tubes may be stably and uniformly maintained.

A water-cooled exhaust gas recirculation (EGR) cooler according to an exemplary embodiment of the present invention includes a plurality of tubes positioned within a housing at a predetermined interval, which form an exhaust gas passage in which exhaust gas passes therethrough, and a tube bonded portion that internally and externally seals the tube is provided at a first side; and a plurality of supporters located between the tubes to define a predetermined interval between the tubes and positioned within the housing wherein a coolant passage in which a coolant flows between the tubes is formed, wherein an external surface of a first side of the supporter is bonded to an external surface of the tubes forming a reinforcing bonded portion wherein the supporter covers and seals the tube bonded portion.

The water-cooled EGR cooler may further include a cooling pin disposed at an internal side of the tube and bonded to an internal surface of the tube. The cooling pin, the tube and the supporter may include aluminum.

The supporter may be formed by bending a sheet in a zig-zag shape, and flow holes, which pass from a first surface to a second surface, may be positioned in the supporter at a predetermined interval.

The tube bonded portion may be formed at the first side of the tube in a longitudinal direction, and a first side of the external surface of the supporter may contact the surface of the tube along the tube bonded portion, forming the reinforcing bonded portion. The tube bonded portion may be formed by facing incision surfaces of the sheet and butt welding at a high frequency. The reinforcing bonded portion may be formed by brazing welding.

The supporter may include a first member extending in a width direction of the tube, and positioned in a longitudinal direction of the tube at a predetermined interval; and a second member integrally or monolithically formed with the first members, extending in the longitudinal direction of the tube, and positioned in the width direction of the tube at a predetermined interval. The first member may be bent in a zig-zag shape, and an external surface of a first side of the first member may support an external surface of the tube disposed at the first side, and an external surface of a second side of the first member may support an external surface of the tube disposed at the second side, and the second member may be bonded to the tubes and form the reinforcing bonded portion wherein the second member covers the tube bonded portion at the tubes disposed at the first side and the second side.

A coolant inlet and a coolant outlet may be formed in a longitudinal direction of the housing at a predetermined interval, and a coolant inlet pipe and a coolant outlet pipe may be connected to the coolant inlet and the coolant outlet, respectively.

An engine according to an exemplary embodiment of the present invention may include the water-cooled EGR cooler. Also, a vehicle according to an exemplary embodiment of the present invention may include the water-cooled EGR cooler.

According to the exemplary embodiment of the present invention, in the tube including a sheet, the supporter is brazed along the bonded portion of the tube to improve corrosive resistance of a welded portion and the durability, and solve a problem that occurs when the coolant is supplied to an intake of the engine, therefore, operation stability of the engine may be improved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
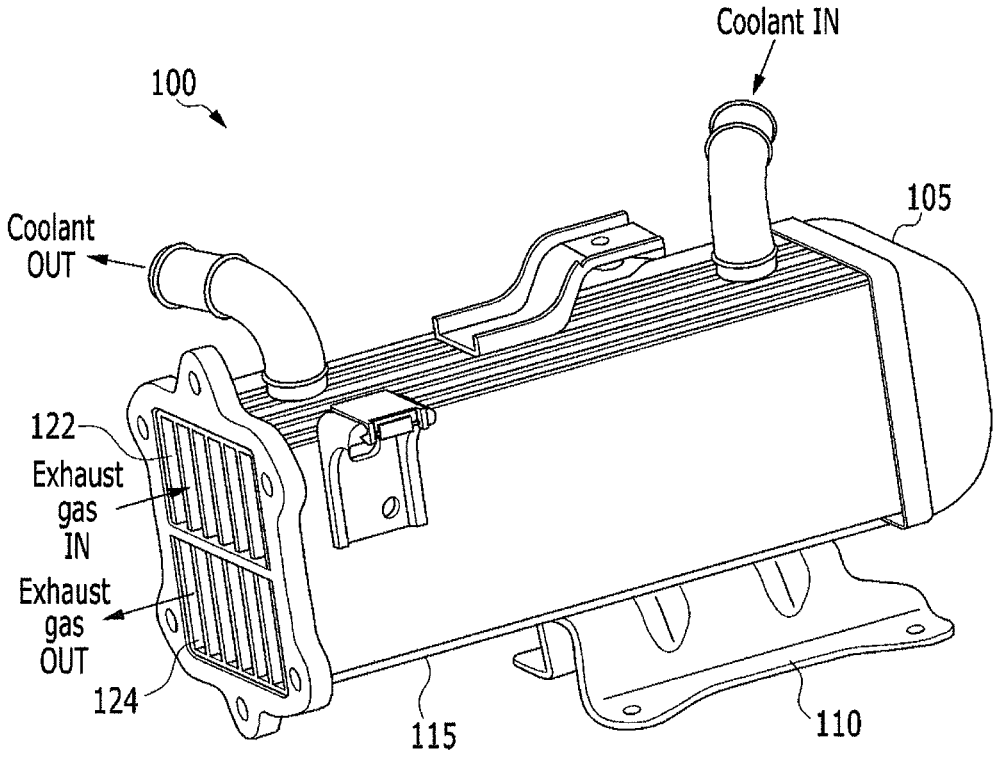
FIG. 1 is a perspective view of an water-cooled EGR cooler according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in portion by the the intended application and use environment.

In the figures, reference numbers refer to the same or equivalent parts of the present innovation throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In addition, the size and thickness of each configuration shown in the drawings are arbitrarily shown for understanding and ease of description, but the present invention is not limited thereto, and the thickness of layers, films, panels, regions, etc., are exaggerated for clarity. Also, the drawings and description are configured to be regarded as illustrative in nature and not restrictive. Like reference numerals designate like elements throughout the specification. Discriminating the names of components with the first, the second, etc. in the following description is for discriminating them for the same relationship of the components and the components are not limited to the order in the following description.

Also, exhaust gas recirculation device may be appended as EGR device or EGR.

FIG. 1 is a perspective view of an water-cooled EGR cooler according to an exemplary embodiment of the present invention.

Referring to FIG. 1, an EGR cooler 100 includes a housing 115, a mounting flange 110, and a 'U'-shaped flange 105 as core components.

A coolant inlet (IN) pipe, into which a coolant flows, is connected to a first end portion at an upper side of the housing 115, and a coolant discharge (OUT) pipe, through which the coolant is discharged, is connected to a second end portion at the upper side of the housing 115.

The 'U'-shaped flange 105 is mounted on the second end surface of the housing 115, and the 'U'-shaped flange 105 allows communication between the upper portion and the lower portion of the housing 115.

An exhaust gas supplied from an exhaust line through an exhaust gas inlet 122 of the housing 115 flows to the upper side of the housing 115, passes through the 'U'-shaped flange 105, flows to the lower side of the housing 115, and is coupled to an intake line through an exhaust gas outlet 124.

Furthermore, the mounting flange 110 fixes the housing 115 to one side of an engine.

Figure 2:
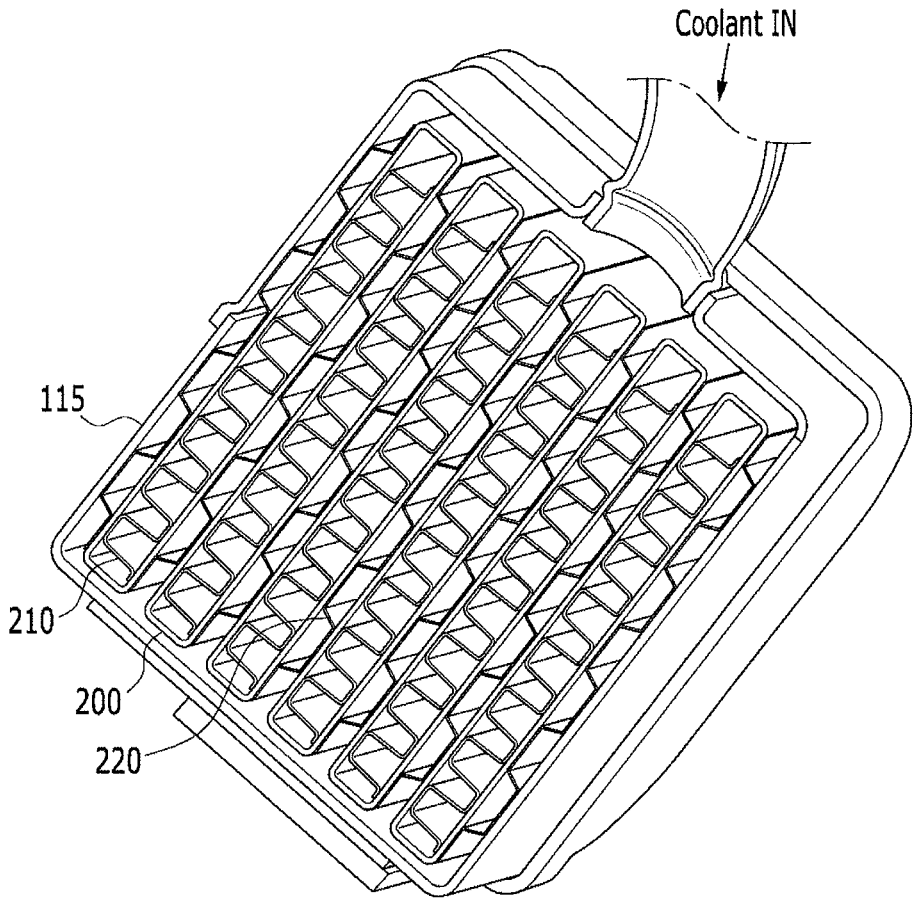
FIG. 2 is a perspective view of a cross-section of a water-cooled EGR cooler according to an exemplary embodiment of the present invention.

FIG. 2 is a perspective view of a cross-section of the water-cooled EGR cooler according to an exemplary embodiment of the present invention.

Referring to FIG. 2, in the EGR cooler 100, a plurality of tubes 200, cooling pins 210, and a plurality of supporters 220 are internally disposed within the housing 115.

The tubes 200 have a thin thickness and a pipe shape having a long width, and extend in a longitudinal direction in which exhaust gas passes. Furthermore, the tubes 200 are positioned at a predetermined interval.

The supporters 220 interpose the tubes 200. The supporters 220 maintain a predetermined interval between the tubes 200, and form a path in which the coolant flows between the tubes 200.

Furthermore, the cooling pins 210 are internally disposed within the tubes 200, and the cooling pins 210 are bent in a zig-zag shape, and an external surface of the cooling pins 210 are brazed and in contact with an internal surface of the tubes 200.

The tubes 200 have a structure wherein the coolant flows into an external side of the tube 200, and the cooling pins 210 disposed at the internal side of the tubes 200 improve an efficiency of heat transfer between the coolant and an EGR gas.

Figure 3:
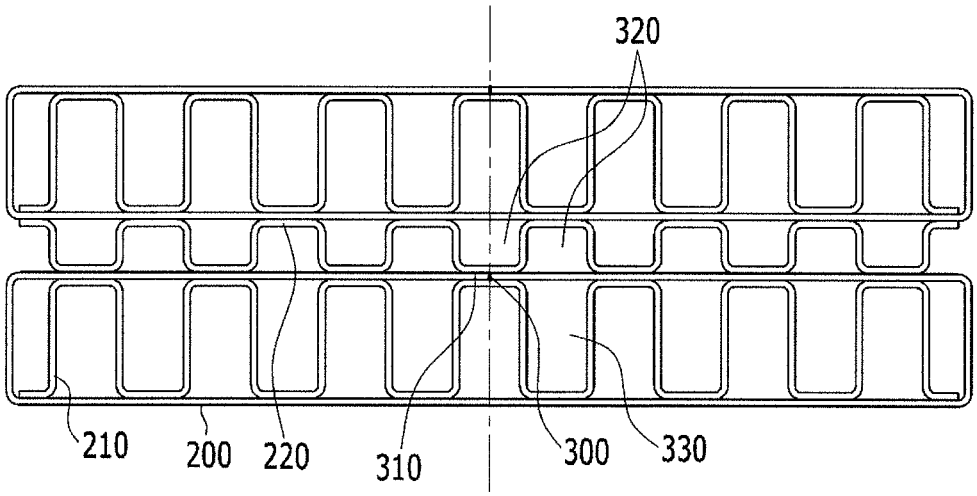
FIG. 3 is a partially detailed cross-sectional view of a water-cooled EGR cooler according to an exemplary embodiment of the present invention.

FIG. 3 is a partially detailed cross-sectional view of the water-cooled EGR cooler according to the exemplary embodiment of the present invention.

Referring to FIG. 3, the water-cooled EGR cooler includes the tubes 200, the cooling pin 210, the supporter 220, a tube bonded portion 300, a reinforcing bonded portion 310, a coolant passage 320, and an exhaust gas passage 330.

The exhaust gas passage 330 is formed within the tubes 200, the coolant passage 320 is formed between the tubes 200, the cooling pin 210 is internally disposed within the tubes 200, and the supporter 220 is disposed between the tubes 200.

The tubes 200 may have sheets in which an incision surface is formed at a first side edge portion and a second side edge portion, and bent in a pipe shape and formed by butt welding. Accordingly, the tube bonded portion 300 is formed at the tubes 200.

The tube bonded portion 300 may be continuously formed in a longitudinal direction, formed by high frequency welding, and formed by butt welding using a laser.

The tubes 200 may be positioned at a predetermined interval, and the supporter 220 interpose the tubes 200. The supporters 220 maintain a predetermined interval between the tubes 200, and the external surfaces of the supporters 200 and the tubes 200 are brazed and bonded to each other. Here, the supporter 220 may be formed by bending a sheet in a zig-zag shape.

In an exemplary embodiment of the present invention, the external surface of a first side of the supporter 220 contacts the external surface of the tube 200 along the tube bonded portion 300, forming the reinforcing bonded portion 310.

The external surface of the first side of the supporter 220 is brazed and bonded to the external surface of the tube 200 to form the reinforcing bonded portion 310 wherein the supporter 220 covers and seals the tube bonded portion 300.

Accordingly, the tube 200 is doubly sealed by the tube bonded portion 300 bonded by high frequency welding and the reinforcing bonded portion 310, therefore corrosive resistance may be improved, and a phenomenon wherein the coolant flowing through the coolant passage 320 leaks through the reinforcing bonded portion 310 and the tube bonded portion 300 into the tube 200 may be effectively prevented.

The cooling pin 210 is internally disposed within the tube 200, the cooling pin 210 is bent in a zig-zag shape, and an external surface of the cooling pin 210 is brazed and contacts an internal surface of the tube 200 to improve the efficiency of heat transfer of the EGR gas.

Figure 4:
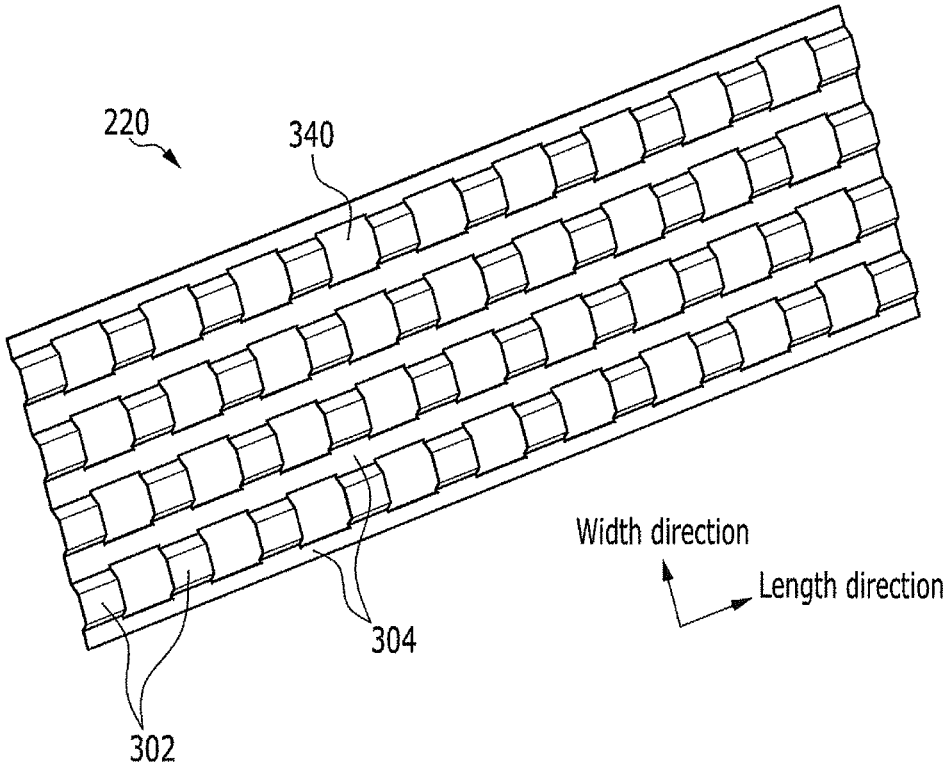
FIG. 4 a perspective view of a supporter applied to a water-cooled EGR cooler according to an exemplary embodiment of the present invention.

FIG. 4 a perspective view of a supporter applied to a water-cooled EGR cooler according to the exemplary embodiment of the present invention.

Referring to FIG. 4, the supporter 220 includes a first member 302 and a second member 304.

The first member 302 extends in a width direction of the tube 200, has a bent structure in a zig-zag shape, and is positioned in a longitudinal direction of the tube 200 at a predetermined interval.

The second member 304 extends in a longitudinal direction, has a linear form, and is positioned in a width direction of the tube 200 at a predetermined interval.

Furthermore, the first and second members 302 and 304 are integrally or monolithically formed by a sheet. A flow hole 340 is formed by the interval between the first and second members 302 and 304, and the flow hole 340 is positioned in a length and a width directions at a predetermined interval.

In an exemplary embodiment of the present invention, the first and second members 302 and 304 may form the flow hole 340 at a predetermined interval and be integrally formed by presser.

Furthermore, the second member 304 is formed in which the coolant flows and has a linear form to reduce a flow resistance of the coolant.

In an exemplary embodiment of the present invention, the tube bonded portion is formed by high frequency welding. The high frequency welding is a welding method wherein current having a high frequency passes through a welding object and generates heat. The detailed description about the present method is referred to well-known technology.

Furthermore, the brazing welding is one of bonding methods of metallic or non-metallic material, in a base material having a melting point of more than 450° C., a bonded portion is heated below the melting point, and the base material is not melted and only filler metal is melted to bond the base material. The detailed description about the present method is referred to well-known technology.

For convenience in explanation and accurate definition in the appended claims, the terms "upper", "lower", "up", "down", "upwards", "downwards", "internal", "outer", "inside", "outside", "inwardly", "outwardly", "internal", "external", "front", "rear", "back", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A water-cooled exhaust gas recirculation (EGR) cooler apparatus, comprising:

a plurality of tubes disposed within a housing at a predetermined interval, which forms an exhaust gas passage in which exhaust gas passes therethrough, and a tube bonded portion that internally and externally seals the tube is provided at a first side thereof; and a plurality of supporters interposing the tubes to define a predetermined interval between the tubes and disposed within the housing wherein a coolant passage, in which a coolant flows between the tubes, is formed, wherein an external surface of a first side of the supporter is bonded to an external surface of the tubes, forming a reinforcing bonded portion wherein the supporter covers and seals the tube bonded portion.

2. The water-cooled EGR cooler apparatus of claim 1, further including:

a cooling pin disposed at an internal side of the tube and being bonded to an internal surface of the tube.

3. The water-cooled EGR cooler apparatus of claim 2, wherein the cooling pin, the tube, and the supporter include aluminum.

4. The water-cooled EGR cooler apparatus of claim 1, wherein the supporter is formed by bending a sheet in a zig-zag shape, and flow holes, which pass from a first surface to a second surface, are disposed in the supporter at a predetermined interval.

5. The water-cooled EGR cooler apparatus of claim 4, wherein the tube bonded portion is formed at a first side of the tube in a longitudinal direction thereof, and a first side of the external surface of the supporter contacts a surface of the tube along the tube bonded portion to form the reinforcing bonded portion.

6. The water-cooled EGR cooler apparatus of claim 1, wherein the tube bonded portion is formed by facing incision surfaces of the sheet and butt welding at a high frequency.

7. The water-cooled EGR cooler apparatus of claim 1, wherein the reinforcing bonded portion is formed by brazing welding.

8. The water-cooled EGR cooler apparatus of claim 1, wherein the supporter includes:

a first member extending in a width direction of the tube, and disposed in a longitudinal direction of the tube at a predetermined interval; and a second member integrally formed with the first members, extending in the longitudinal direction of the tube, and disposed in the width direction of the tube at a predetermined interval.

9. The water-cooled EGR cooler apparatus of claim 8, wherein the first member is bent in a zig-zag shape, and an external surface of a first side of the first member supports an external surface of the tube disposed at a first side thereof, and an external surface of a second side of the first member supports an external surface of the tube disposed at a second side of the tube, and the second member is bonded to the tubes and forms the reinforcing bonded portion wherein the second member covers the tube bonded portion at the tubes disposed at a first side and a second side thereof.

10. The water-cooled EGR cooler apparatus of claim 1, wherein a coolant inlet and a coolant outlet are formed in a longitudinal direction of the housing at a predetermined interval, and a coolant inlet pipe and a coolant outlet pipe are fixedly connected to the coolant inlet and the coolant outlet, respectively.

* * * * *